US012060627B1

(12) United States Patent
Na et al.

(10) Patent No.: US 12,060,627 B1
(45) Date of Patent: Aug. 13, 2024

(54) HARD MAGNETIC PROPERTIES OF HIGH ENTROPY ALLOYS (HEAS), METHODS FOR MAKING HEAS, AND USES THEREOF

(71) Applicant: The Government of the United States of America, as represented by the Secretary of the Navy, Arlington, VA (US)

(72) Inventors: Suok-Min Na, Laurel, MD (US); Nicholas J. Jones, Fairfax, VA (US); Paul K. Lambert, Columbia, MD (US)

(73) Assignee: The United States of America, as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 17/513,130

(22) Filed: Oct. 28, 2021

Related U.S. Application Data

(60) Provisional application No. 63/107,805, filed on Oct. 30, 2020.

(51) Int. Cl.
*C22C 30/02* (2006.01)
*C22C 1/02* (2006.01)
*C22F 1/16* (2006.01)

(52) U.S. Cl.
CPC ..... *C22C 30/02* (2013.01); *C22C 1/02* (2013.01); *C22F 1/16* (2013.01)

(58) Field of Classification Search
CPC ..... C22C 30/02; C22C 1/02; C22F 1/16
See application file for complete search history.

(56) References Cited

U.S. PATENT DOCUMENTS

| | | | | |
|---|---|---|---|---|
| 8,308,874 | B1 | 11/2012 | Clark et al. | |
| 10,655,196 | B2 | 5/2020 | Lee et al. | |
| 10,889,870 | B2 | 1/2021 | Obayashi et al. | |
| 10,988,834 | B2 | 4/2021 | Lee et al. | |
| 11,168,386 | B2 | 11/2021 | Lee et al. | |
| 11,359,266 | B2 | 6/2022 | Yang et al. | |
| 11,530,468 | B2 | 12/2022 | Wu | |
| 2002/0159914 | A1* | 10/2002 | Yeh | C22C 1/02 420/580 |
| 2017/0349983 | A1 | 12/2017 | Jin et al. | |
| 2021/0262074 | A1 | 8/2021 | Stewart et al. | |
| 2022/0056567 | A1 | 2/2022 | Yang et al. | |

(Continued)

FOREIGN PATENT DOCUMENTS

| | | | | |
|---|---|---|---|---|
| CN | 104561878 A | * | 4/2015 | |
| CN | 109252083 A | * | 1/2019 | C22C 19/058 |

(Continued)

OTHER PUBLICATIONS

CN-109252083-A, Sun et al. (Machine translation) (Year: 2019).*

(Continued)

*Primary Examiner* — John A Hevey
(74) *Attorney, Agent, or Firm* — Dawn C. Russell; Howard Kaiser

(57) ABSTRACT

High entropy alloys (HEAs) are provided, which exhibit hard magnetic properties, including increased saturation magnetization, improved coercivity, and thermal stability at temperatures exceeding about 200° C. Methods of making the HEAs are also provided, as well as methods for using the HEAs, particularly in extreme environments.

18 Claims, 5 Drawing Sheets

(56) References Cited

U.S. PATENT DOCUMENTS

2022/0411902 A1 12/2022 Niarchos

FOREIGN PATENT DOCUMENTS

DE 102018201855 A1 9/2019
JP 08246049 A 9/1996

OTHER PUBLICATIONS

CN 104561878A, Zhang et al. (machine translation). (Year: 2015).*
M.J. Kramer, et al., "Prospects for Non-Rare Earth Permanent Magnets for Traction Motors and Generators," JOM 64(7):752-763 (2012).
D.B. Miracle and O.N. Senkov, "A critical review of high entropy alloys and related concepts," Acta Mater. 122, 448-511 (2017).
S.M. Na, et al., "Room-temperature ferromagnetic transitions and the temperature dependence of magnetic behaviors in FeCoNiCr-based high-entropy alloys," AIP Advances 8, 056412, pp. 1-7 (2018).
T. Technology Co., Ltd. 2013, "Magnetic properties of Sintered Al—Ni—Co permanent magnets", accessed Oct. 26, 2021, <www.t-technology.co.jp/alnico--english.html>.
L. Zhou, et al., "Architecture and magnetism of alnico," Acta Mater. 74, 224-233 (2014).
Y. Iwama and M. Takeuchi, "Spinodal Decomposition in Alnico 8 Magnet Alloy," Trans. JIM 15, 371-377 (1974).
V. Sergeyev and T.Y. Bulygina, "Magnetic Properties of Alnico 5 and Alnico 8 Phases at the Sequential Stages of Heat Treatment in a Field," IEEE Trans. Magn., vol. MAG-6, No. 2, 194-198 (1970).
M. Takeuchi and Y. Iwama, "Effects of Titanium upon Magnetic Anisotropy and Coercivity in Alnico Magnet Alloys," Trans. JIM 17, 489-496 (1976).
MMPA Standard No. 0100-00, "Standard Specification for Permanent Magnet Materials", Magnetic Materials Producers Association, Chicago, IL.
L. Zhou, et al., "Microstructure and Coercivity in Alnico 9," J. Magn. Magn. Mater. 471, 142-147 (2019) (open manuscript provided).
U.S. Appl. No. 17/523,863, Paul Lambert et al., High-Strength and High-Toughness Austenitic Steel, filed Nov. 10, 2021.
U.S. Appl. No. 17/149,473, Suok-Min Na et al., "High-Entropy Alloys (HEAs), Methods for Making HEAs, and Uses Thereof," filed Jan. 14, 2021.
U.S. Appl. No. 62/960,935, Suok-Min Na et al., "High-Entropy Alloys (HEAs), Methods for Making HEAs, and Uses Thereof," filed Jan. 14, 2020.
U.S. Appl. No. 63/111,965, Paul Lambert et al., High-Strength and High-Toughness Austenitic Steel, filed Nov. 10, 2021.
U.S. Appl. No. 63/107,805, Suok-Min Na et al., Hard Magnetic Properties of High-Entropy Alloys, Methods for Making HEAs, and Uses Thereof filed Oct. 30, 2020.
U.S. Appl. No. 17/183,879, Colin A. Stewart et al., "Multi Nano-Precipitate Strengthened Austenitic Steel," filed Feb. 24, 2021.
U.S. Provisional U.S. Appl. No. 62/980,766, filed Feb. 24, 2020.
Suok-Min Na, Paul K. Lambert and Nicholas J. Jones, "Hard magnetic properties of FeCoNiAlCuXTiX based high entropy alloys," AIP Advances 11, 015210 (2021), Accepted Nov. 30, 2020, Published Online Jan. 6, 2021.
Suok-Min Na, Jin-Hyeong Yoo, Paul K. Lambert, Nicholas J. Jones, "Room-temperature ferromagnetic transitions and the temperature dependence of magnetic behaviors in FeCoNiCr-based high-entropy alloys," AIP Advances 8, 056412 (2018), Dec. 21, 2017.
Jia Yan Law, Victorino Franco, "Pushing the limits of magnetocaloric high-entropy alloys," APL Materials 9, 080702 (2021), Aug. 23, 2021.
Final Office action including attachments (dated Sep. 28, 2023; 16 pages), U.S. Appl. No. 17/149,473, Suok-Min Na et al., "High-Entropy Alloys (HEAs), Methods for Making HEAs, and Uses Thereof," filed Jan. 14, 2021.
Nonfinal Office action (including attachments) dated Dec. 14, 2023, 13 pages, U.S. Appl. No. 17/149,473, Suok-Min Na et al., "High-Entropy Alloys (HEAs), Methods for Making HEAs, and Uses Thereof," filed Jan. 14, 2021.
U.S. Nonprovisional U.S. Appl. No. 18/496,999, Suok-Min Na et al., "High-Entropy Alloys (HEAs), Methods for Making HEAs, and Uses Thereof," filed Oct. 30, 2023, Navy Case No. 112,356-US03.

* cited by examiner

HARD MAGNETIC PROPERTIES OF HIGH ENTROPY ALLOYS (HEAS), METHODS FOR MAKING HEAS, AND USES THEREOF

CROSS REFERENCE TO RELATED APPLICATIONS

This patent application claims priority to U.S. Provisional Application No. 63/107,805, filed on Oct. 30, 2020. The entire contents of the provisional application are incorporated herein by reference.

FIELD OF THE INVENTION

High entropy alloys (HEAs) are provided, which exhibit hard magnetic properties, including increased saturation magnetization, improved coercivity, and thermal stability at temperatures well exceeding about 200° ° C. Methods of making the HEAs are also provided, as well as methods for using the HEAs, particularly in extreme environments.

BACkGROUND OF THE INVENTION

Neodymium-based permanent magnets (PMs) have many advantages over rare-earth free PMs in electronic devices and machines. There is still, however, a critical need for the development of new rare-earth (RE) free magnetic materials, due to an ever-increasing demand for permanent magnets and significant challenges in material availability caused by a rare-earth supply crisis (M. J. Kramer, et al., *JOM* 64, 752 (2012)).

High entropy alloys (HEA) provide a unique composition space for alloy development, by virtue of their large configurational entropy due to the inclusion of five or more principal alloying elements (D. B. Miracle and O. N. Senkov, *Acta Mater.* 122, 448 (2017)). Magnetic HEAs are also promising in this field due to their unusual magnetic characteristics which greatly depend on the crystal structure and chemical composition of these alloys (S. M. Na, et al., *AIP Advances* 8, 056412 (2018)).

Among the commercialized RE-free magnets, Alnico magnets, comprised of Fe, Co, Ni, Al and other minor additions, show great potential for replacing RE-based magnets in specific applications. These alloys can be made large enough for use in devices such as motors and generators and can be used at elevated temperatures (>+180° C.) due to their high Curie temperatures of ~750-870° C. (T. Technology Co., Ltd. 2013, "Magnetic properties of Sintered Al—Ni—Co permanent magnets", accessed Oct. 26, 2021, <www.t-technology.co.jp/alnico--english.html>).

The maximum energy product, $(BH)_{max}$, in Alnico magnets is also fairly temperature independent up to ~300° C., while rare earth, Nd-based magnets show a significant drop-off from ~45 MGOe at room temperature to below 10 MGOe at 200° C. (M. J. Kramer, et al., *JOM* 64, 752 (2012)). While these RE-free alloys possess a more stable temperature performance, their room temperature $(BH)_{max}$ values are comparatively quite low (~1-10 MGOe) although the residual induction ($B_r$) is similar to that of the Nd-based magnets.

While the energy product is low, there appears to be much room for improvement. Zhou et al. found a large discrepancy between experimentally measured coercivity ($H_C$) and theoretical predictions, so there may still be viable alloy improvements (L. Zhou, et al., *Acta Mater.* 74, 224 (2014)). The experimental $H_C$ values obtained from the Alnico alloy series 5-7, series 8 and series 9 only approach 22-48% of the theoretical limits of 3.3-3.9 kOe, indicating a possible improvement in $(BH)_{max}$, which can reach 17-21 MGOe if the theoretical values could be realized.

None of the RE-free HEAs developed to date provide hard magnetic properties with a maximum energy product as high as RE alloys, although they can exhibit relatively stable performance at high temperatures.

SUMMARY OF THE INVENTION

The invention described herein including the various aspects and/or embodiments thereof, meets the unmet needs of the art, as well as others, by providing HEAs that exhibit hard magnetic properties, including increased saturation magnetization, improved coercivity, and thermal stability at temperatures exceeding about 200° C. Methods of making the HEAs are also provided, as well as methods for using the HEAs.

According to a first aspect of the invention, high entropy alloys are provided which have the formula $Fe_yCo_zNiAlCu_XTi_X$, where each x is independently selected, and is from 0 to 1, y is 1 or 2, and z is 1 or 2. In some embodiments, the high entropy alloys are rare-earth free high entropy alloys.

Another aspect of the invention provides high entropy alloys consisting of $Fe_2CoNiAlCu_{0.4}Ti_{0.4}$.

Another aspect of the invention provides methods for forming high entropy alloys including: assembling high-purity sources of elements selected from the group consisting of Fe, Co, Ni, Al, Cu, Ti, and combinations thereof; combining the elements in a melting apparatus, at least partially melting the elements to form an initial mixture; conducting an alloying operation in which the initial mixture of elements is heated until fully molten, forming an alloy; once fully molten, stirring the alloy to mix the elements; and remelting the alloy.

Methods for using high entropy alloys in applications selected from the group consisting of motors, generators, exhaust systems, and petroleum-extraction equipment are also provided.

The high entropy alloys of the invention may also be used in applications subject to shock and impact forces.

The high entropy alloys of the invention may further be used in environments subject to high temperature, radiation, and corrosion. Such environments may be encountered, for example, in space exploration.

Other features and advantages of the invention will become apparent to those skilled in the art upon examination of the following or upon learning by practice of the invention.

DETAILED DESCRIPTION OF THE INVENTION

Figure 1A:
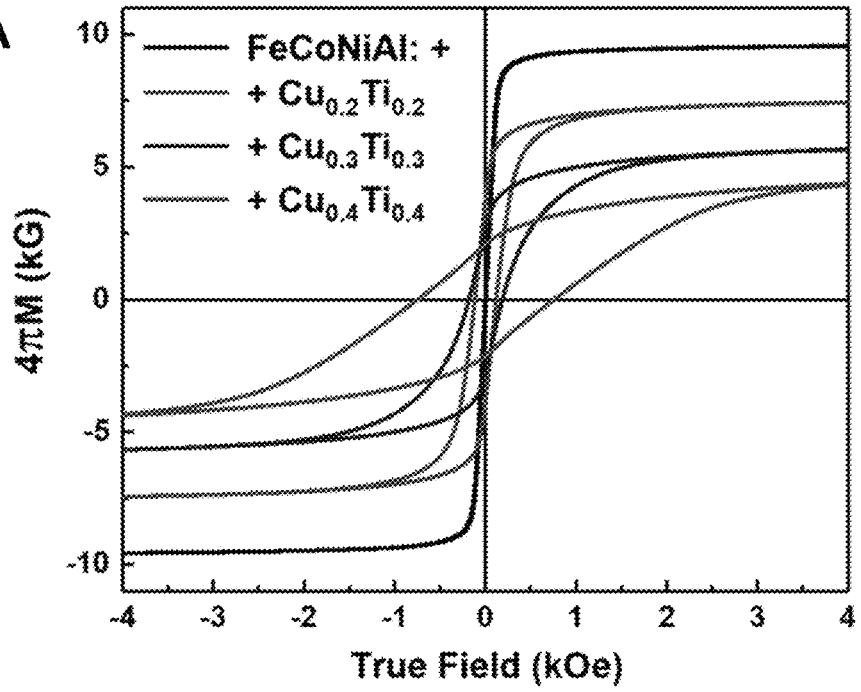
FIG. 1A shows demagnetization-corrected magnetic hysteresis loops of high entropy alloys (HEAs) with varying CuTi additions to an equimolar FeCoNiAl base optimally annealed at a temperature of 700° C.

High entropy alloys (HEAs) are provided, which exhibit hard magnetic properties, including increased saturation magnetization, improved coercivity, and thermal stability at temperatures exceeding about 200° C. Methods of making the HEAs are also provided, as well as methods for using the HEAs.

High entropy alloys (HEA) contain multiple principal alloying elements, and possess unique properties due to the high configurational entropy and lattice strain in the system. Ferromagnetic FeCoNi-based HEAs exhibit dramatic changes in crystal structure and the type of magnetism expressed when adding non-magnetic elements such as Al, Ga, Ti, etc.

In some embodiments, the HEAs are preferably free of rare-earth (RE) elements such as cerium (Ce), dysprosium (Dy), erbium (Er), europium (Eu), gadolinium (Gd), holmium (Ho), lanthanum (La), lutetium (Lu), neodymium (Nd), praseodymium (Pr), promethium (Pm), samarium (Sm), scandium (Sc), terbium (Tb), thulium (Tm), ytterbium (Yb), and yttrium (Y). When compared to RE magnets, the HEAs of the invention exhibit more temperature stability, better mechanical robustness, and better high temperature performance (for example, they beneficially maintain their maximum energy product (MGOe), even at elevated temperatures (as compared to RE magnets that exhibit a drop in MGOe above room temperature)). In some embodiments, trace amounts of RE elements may be present in the HEAs of the invention, for example, less than 1 at %.

The HEAs of the invention are alloys that contain five or more elements, where each element is provided at a concentration from about 10 to about 35 at %, preferably from about 15 to about 25 at %, more preferably from about 18 to about 22 at %. In some aspects of the invention, the HEAs are alloys that contain six or more elements, where each element is provided at a concentration of about 10 to about 25 at %, preferably from about 12 to about 22 at %, more preferably from about 14 to about 20 at %.

In additional aspects of the invention, the elements of the HEA are provided in equiatomic or near-equiatomic ratios, i.e., about 15 to about 18 at % of each element for an alloy of six elements, preferably about 16.67 at % of each element for an alloy of six elements.

The HEAs of the invention may be formed from a base alloy of Fe, Co, Ni, and Al. In addition to these elements, one or more alloying additions selected from the group consisting of Cu and/or Ti may be incorporated into the HEAs. In further aspects of the invention, the ratio of Fe and Co with respect to the other alloying elements may also be varied. The alloying addition(s) are preferably provided in an amount ranging from about 15 to about 25 at %. In one aspect of the invention, the HEA is formed from about 8.33 at % Cu and Ti, and the balance is a combination of elements comprising Fe, Co, Ni, and Al in a 1:1:1:1 ratio.

In some aspects, the invention provides $Fe_yCo_zNiAlCu_x$-$Ti_x$ HEAs, where x may be from 0 to about 1, y is 1 or 2, and z is 1 or 2. Variations in annealing temperature and Cu/Ti dopant additions alter the structural and hard magnetic properties of these HEAs. Variations in the atomic ratio of the Fe/Co ferromagnetic elements may also influence structural and hard magnetic properties. The total value of x when both Cu and Ti are present preferably does not exceed 1 (i.e., $x_{Cu}+x_{Ti}<1$). More preferably, when Cu and Ti are both present, x is from about 0.2 to about 0.4.

The HEAs of the invention exhibit hard magnetic properties and innovative alloy designs, and exhibit increased performance as compared to existing Alnico alloys. They may be beneficially used in applications including, but not limited to, motors and generators. The HEAs of the invention may also be beneficially used in any application where RE magnets are used, and are particularly beneficial in environments that are subject to elevated temperatures (i.e., above room temperature). These environments include, but are not limited to, motors and engine rooms, exhaust ducts and other exhaust areas, petroleum extraction apparatus, desert or tropical environments, and space applications.

In some aspects of the invention, Cu is added to the base alloy to form an HEA having the composition FeCoNiAlCu. In some aspects of the invention, Ti is added to the base alloy to form an HEA having the composition FeCoNiAlTi. In other aspects of the invention, Cu and Ti are added to the base alloy to form an HEA having the composition FeCoNiAlCuTi.

The HEAs of the invention exhibit hard magnetic properties, including increased saturation magnetization, improved coercivity, and thermal stability at temperatures exceeding about 200° C.

The addition of Cu/Ti to an equimolar FeCoNiAl alloy is effective at enhancing coercivity, due to spinodal decomposition, but at the expense of saturation magnetization. By varying the ratio of Fe and Co, however, with respect to the other alloying elements, the saturation magnetization is increased, while generally retaining or improving the coercivity. In particular, the $Fe_2CoNiAlCu_{0.4}$ $Ti_{0.4}$ HEA shows promising hard magnetic properties as an isotropic cast magnet, with an $H_C$ of 1,078 Oe and $(BH)_{max}$ of 2.06 MGOe, slightly better than the performance of isotropic cast Alnico 2 magnets. The thermal stability is also sufficient for use at elevated temperatures over 200° C. There was also an interesting increase in high temperature coercivity observed at temperatures from ~650-800° C., where these alloys often exhibited higher coercivity than that measured at room temperature.

The invention also provides methods for forming HEAs. The methods beneficially form stable, solid solutions of the elements. The HEAs of the invention are distinct from intermetallic materials, which have defined stoichiometries and ordered crystal structures.

The methods include assembling high-purity sources of each element included in the HEA. In some aspects of the invention, the elements are provided with at least 99.98% purity. The elements are combined in a melting furnace or other melting apparatus for initial melting and mixing. In some aspects of the invention, the elements are provided in a vacuum arc-melting apparatus that is backfilled using argon gas, in order to be melted for the initial melting and mixing step. The mixed elements preferably form a cohesive mass as a result of the initial melting and mixing, but may not be fully intermixed. The alloying operation is conducted, during which the elements are fully intermixed, in order to form the alloy. Once fully molten, the alloy is stirred to mix the elements, and re-melted. The stirring and remelting steps are preferably carried out from 3 to 8 times to achieve uniform mixing.

Those skilled in the art will appreciate that the temperatures at which the melting, alloying, and re-melting are conducted may vary. Preferably, the initial mixing step is conducted at a temperature that is higher than the melting point of the element having the lowest melting point (in this case, aluminum, with a m.p. of 660.3°) C., but is not so high that the lowest-melting point element is vaporized before alloying occurs (i.e., below the boiling point of aluminum, 2470°) C. After initial mixing, the heat may be increased to a temperature sufficient for the alloy elements to be melted during the alloying operation (e.g., cobalt, m.p. 1495° C.; nickel, m.p. 1455° C.; iron, m.p. 1538° C.; copper, m.p. 1085° C.; and titanium, m.p. 1668° C.), and may optionally be increased again for the stirring/remelting steps. In some aspects of the invention, the temperature used during the alloying operation is used throughout the stirring/remelting steps.

The alloy material is then be annealed at temperatures that range from about 600° C. to about 1000° C. for 2-4 hours, preferably about 3 hours. In some aspects of the invention, the annealing is carried out in a high temperature furnace.

The HEAs of the invention may also be used in methods for replacing RE magnets in motors, generators, and in high-temperature environments where RE magnets are used. The HEAs of the invention may also be beneficially used in any application where RE magnets are used, and are particularly beneficial in environments that are subject to elevated temperatures, radiation, corrosion, shock, and/or impacts. These environments include, but are not limited to, motors and engine rooms, exhaust ducts and other exhaust areas, petroleum extraction apparatus, desert or tropical environments, and space applications.

EXAMPLES

The invention will now be particularly described by way of example. However, it will be apparent to one skilled in the art that the specific details are not required in order to practice the invention. The following descriptions of specific embodiments of the present invention are presented for purposes of illustration and description. They are not intended to be exhaustive of or to limit the invention to the precise forms disclosed. Many modifications and variations are possible in view of the above teachings. The embodiments are shown and described in order to best explain the principles of the invention and its practical applications, to thereby enable others skilled in the art to best utilize the invention and various embodiments with various modifications as are suited to the particular use contemplated.

Example 1. Ingot Preparation

Ingots weighing approximately 60 grams with nominal compositions of FeCoNiAl, $FeCoNiAlCu_x$ (X=0.1-1.0), $FeCoNiAlCu_XTi_X$ (X=0.2-0.4) and $Fe_XCo_YNiAlCu_{0.4}Ti_{0.4}$ (X and/or Y=1, 2) were prepared by arc melting under a high purity argon atmosphere. The purity of the elements was higher than 99.99 atomic percent (at. %) and the ingots were remelted five times. Slices with a thickness of ~1.0 mm were cut from each ingot. Discs were then cut from these slices, with a diameter of ~6.25 mm for microstructural analysis and magnetic measurements. Each disc sample was sequentially annealed for 3 hours at temperatures from 400 to 900° C. in 100° increments, and furnace cooled after each heat treatment before testing and reannealing. The magnetic field dependence of magnetization (M-H) was measured at temperatures from 25° C. up to 1,000° C. in 50° increments using a Lakeshore vibrating sample magnetometer (VSM) with the high temperature attachment, under applied magnetic fields up to ±20 kOe; applied field values were corrected for sample shape anisotropy. X-ray diffraction (XRD) was performed to determine the crystallographic phases present.

To analyze structural properties, the sample surfaces were mechanically polished up to 1500 grit-size abrasive SiC media. After mechanical polishing, alumina solutions with particle sizes of 1 μm and 0.3 μm were used on the samples in a mechanical polishing machine (Struers). Subsequently, silica gel with a particle size of 0.06 μm was used as the last step in the polishing process. The polished sample was placed in a scanning electron microscope (SEM) and tilted 70° to get electron backscatter diffraction (EBSD) patterns. The EBSD patterns were captured and analyzed for assessment of phase, grain configuration and grain area fraction using orientation imaging microscopy (OIM) data collection software (TSL OIM Analysis 5).

Figure 1B:
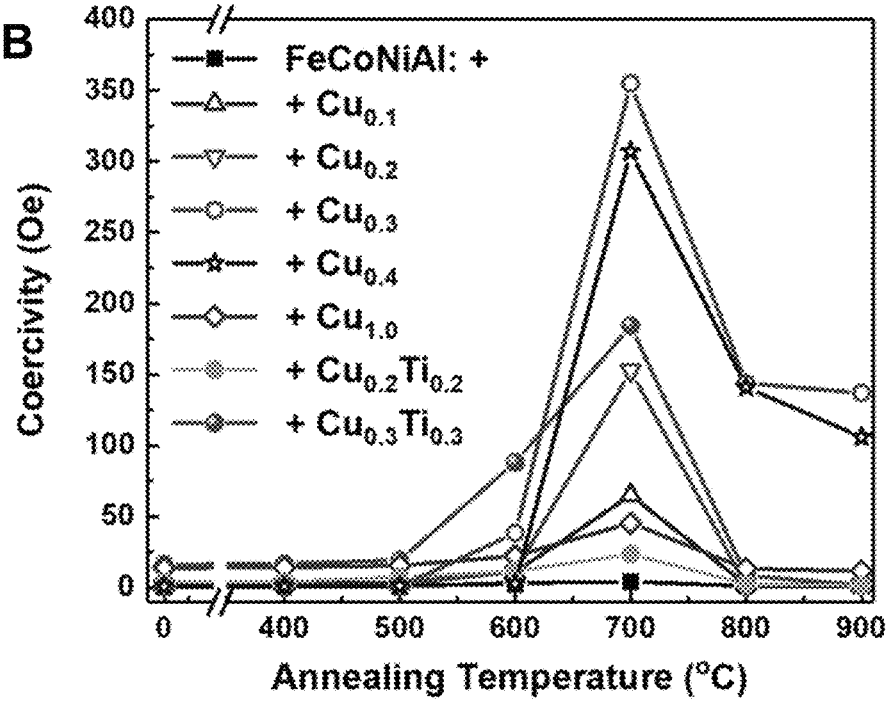
FIG. 1B shows the coercivity values as a function of sequential annealing temperatures, with Cu and/or Ti additions to the FeCoNiAl alloy. NOTE: $H_C$ for+$Cu_{0.4}$ $Ti_{0.4}$ is included in FIG. 2B.

The equiatomic FeCoNiAl alloy exhibits relatively soft magnetic behavior with high permeability and low coercivity, independent of annealing treatment (see FIGS. 1A-1B). In contrast, the coercivity of alloys containing Cu and Ti is heavily dependent on the annealing condition, with all alloys exhibiting a maximum value after an anneal at ~700° C., which might be due to spinodal decomposition, as is often observed in Alnico magnets (see FIG. 1B) (Y. Iwama and M. Takeuchi, *Trans. JIM* 15, 371 (1974)). After annealing at the optimal conditions, Cu additions drastically increase the coercivity of the $FeCoNiAlCu_X$ alloy from 4 Oe to 355 Oe at a value of only X=0.3 (8.68 wt. %), after which the coercivity drops off again. Similarly, binary additions of Cu and Ti also increase the coercive field, but more gradually. The $Cu_{0.3}$ $Ti_{0.3}$ addition exhibits a low $H_C$ of 185 Oe, compared to that of the $Cu_{0.3}$ alone (the $Cu_{0.3}/Ti_{0.3}$ additions equal 8.15 and 6.14 wt. %, respectively). However, it jumps to 881 Oe in the $Cu_{0.4}Ti_{0.4}$ sample (additions equal 10.37 and 7.82 wt. %, respectively). This is apparently due to the Ti addition. The increase in the coercive field is also accompanied by a decrease in the saturation magnetization, due to the inclusion of non-magnetic elements. Sergeyev and Bulygina (V. Sergeyev and T. Y. Bulygina, *IEEE Trans. Magn.*, Vol. MAG-6, No. 2, 194-198 (1970)) and Takeuchi and Iwama (M. Takeuchi and Y. Iwama, *Trans. JIM* 17, 489 (1976)) both investigated the effect of Ti on the coercivity of Alnico PMs and the role of heat treatment on performance, similarly noting an increase in coercivity and decrease in saturation magnetization. The observed trend agrees well with our results for Cu/Ti-added FeCoNiAl HEAs as shown in FIG. 1A. The 4πMs of 5.6 kG in the $FeCoNiAlCu_{0.4}Ti_{0.4}$ HEA, however, is lower than Alnico 8 (11.87 kG) and Takeuchi's alloy (10.3 kG). It might be due to the difference in percentage of the ferromagnetic phase. Here, the total weight fraction of the Fe/Co ferromagnetic major components is 46.8 wt. % in the $+Cu_{0.4}$ $Ti_{0.4}$ HEA, while Alnico 8 and Takeuchi's alloys include 68.5 and 70.1 wt. %, respectively.

Figure 2A:
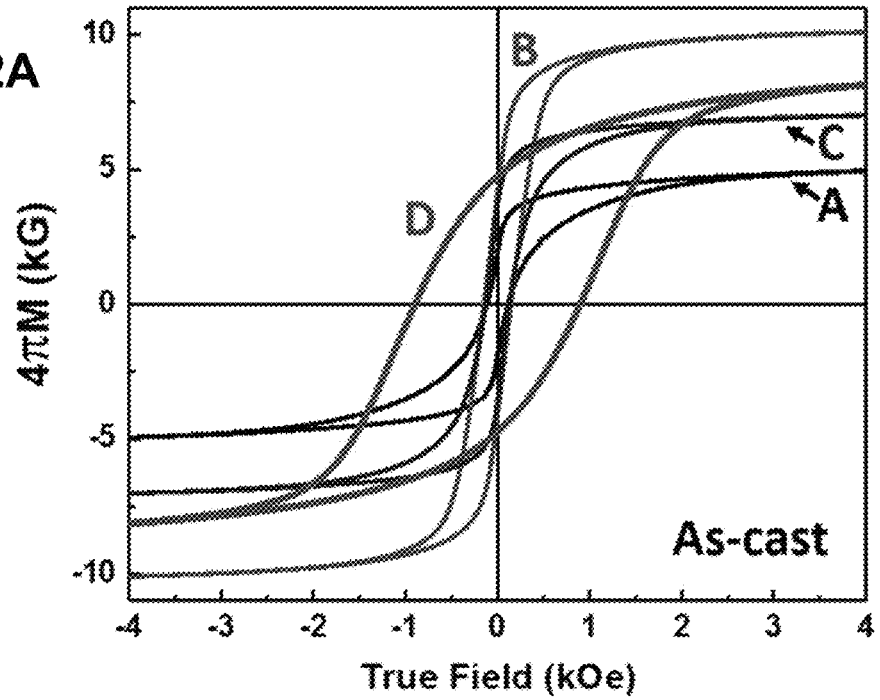
FIG. 2A shows demagnetization-corrected magnetic hysteresis loops measured at room temperature (RT) in the as-cast condition.
Figure 2B:
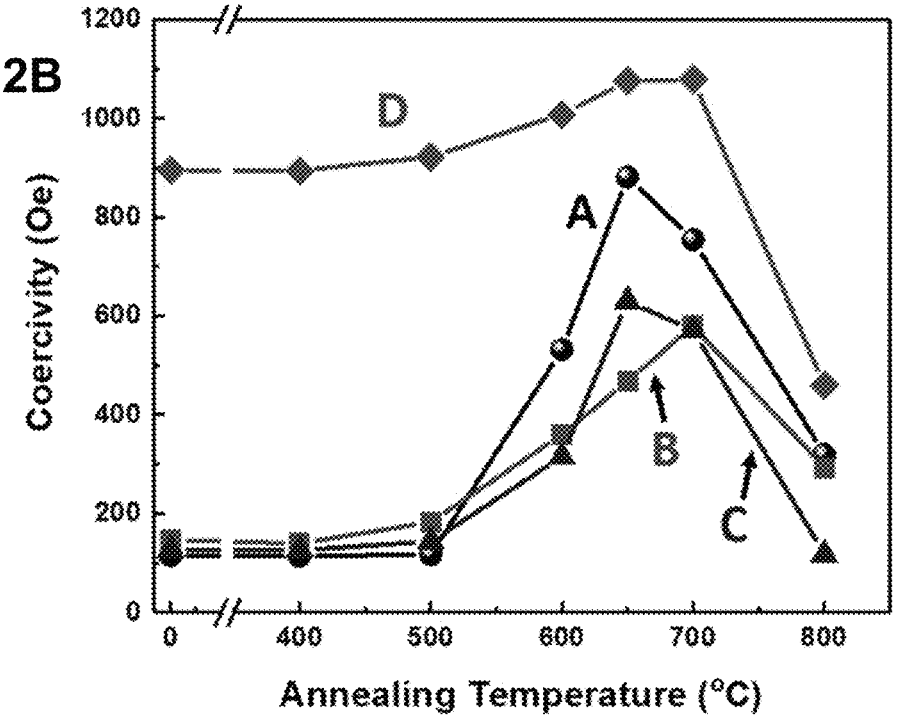
FIG. 2B shows the coercivity measured at RT as a function of sequential annealing temperatures for four different HEAs with $Cu_{0.4}$ $Ti_{0.4}$ additions: A—$FeCoNiAlCu_{0.4}Ti_{0.4}$, B—$Fe_2CO_2NiAlCu_{0.4}Ti_{0.4}$, C—$FeCo_2NiAlCu_{0.4}$ $Ti_{0.4}$, and D—$Fe_2CoNiAlCu_{0.4}Ti_{0.4}$.
Figure 3A:
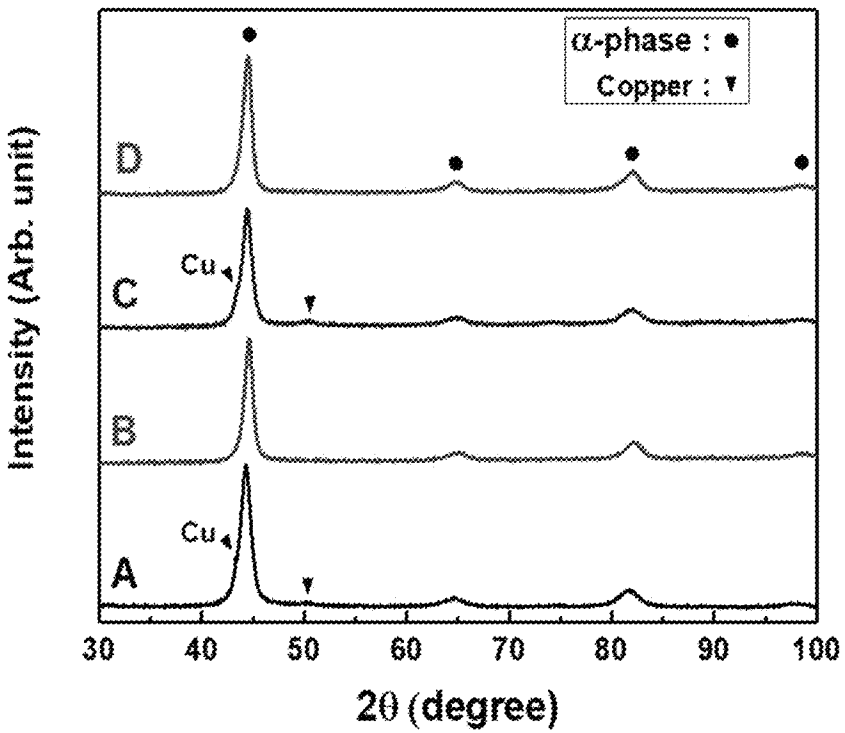
FIG. 3A depicts X-ray diffraction patterns of as-cast HEAs: A—$FeCoNiAlCu_{0.4}$ $Ti_{0.4}$, B—$Fe_2CO_2NiAlCu_{0.4}Ti_{0.4}$, C—$FeCo_2NiAlCu_{0.4}Ti_{0.4}$, and D—$Fe_2CoNiAlCu_{0.4}Ti_{0.4}$.
Figure 3B:
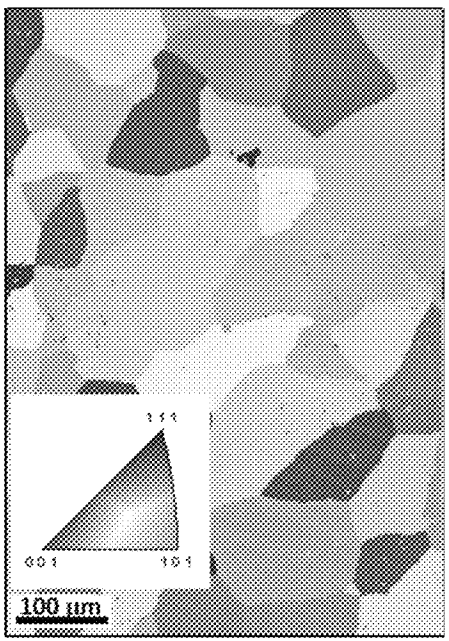
FIGS. 3B-3C are inverse pole figure images (IPF) of different areas of alloy D with different magnifications.
Figures 3C, 3D, 3E:
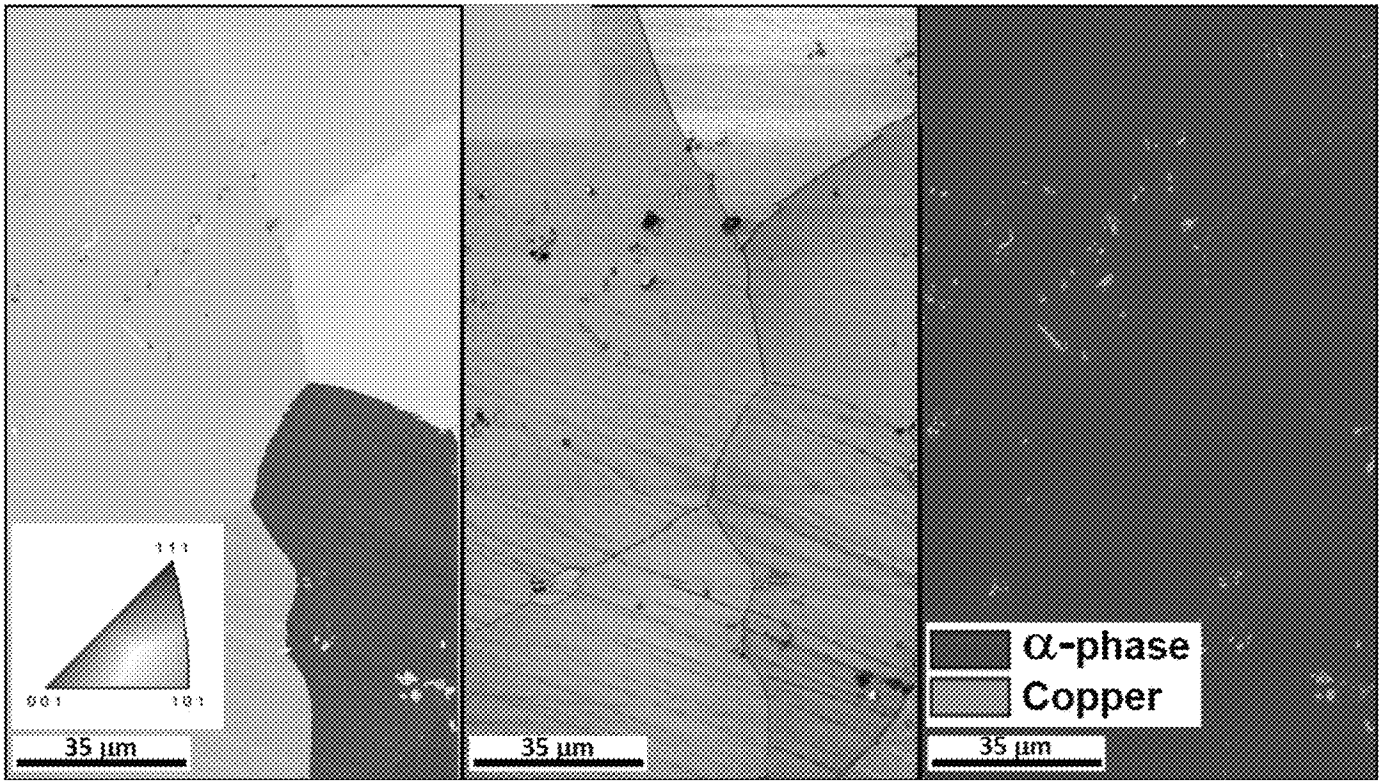
FIG. 3D is an image quality (IQ) of the IPF of FIG. 3C.
FIG. 3E is a phase map of the IPF of FIG. 3C.

To further enhance Ms, $H_C$ and $(BH)_{max}$, the additions of $Cu_{0.4}$ $Ti_{0.4}$ were introduced to different HEA bases with various molar ratios of Fe/Co: FeCoNiAl $Cu_{0.4}Ti_{0.4}$ (noted as Alloy A), $Fe_2CO_2NiAl$ $Cu_{0.4}$ $Ti_{0.4}$ (Alloy B), $FeCo_2NiAl$ $Cu_{0.4}Ti_{0.4}$ (Alloy C) and $Fe_2CoNiAl$ $Cu_{0.4}$ $Ti_{0.4}$ (Alloy D). By favoring Fe/Co in the mix, we are moving towards a higher atomic saturation moment, according to the Slater-Pauling curve (S. Chikazumi and C. D. Graham, *Physics of Ferromagnetism*, Oxford University Press, USA (1997), p. 174). All alloys show an increase in saturation magnetization with additions of Fe+Co in the as-cast condition, but with no improvement in $H_C$, except for alloy D (see FIG. 2A). Alloy B had the highest fraction of Fe+Co (63.8 wt. % or 58.8 at. %), and correspondingly had the highest 4πMs of 10.4 kG, with a similar value to the 4πMs in Takeuchi's alloy, which had a comparable Fe+Co weight fraction of 68.5 wt. % (62.8 at. %). Alloy D had the next highest 4πMs, which agrees with the Slater-Pauling curve, since Fe will provide a greater impact to 4πMs than Co, as we move towards the peak of the curve from the right. In the as cast condition, the three alloys noted as A-C have narrow hysteresis loops with low $H_C$ values of ~115-145 Oe. The as-cast ingot samples have a BCC structure with some copper segregation in alloys A and C, as shown in FIG. 3A. In contrast, Alloy D has a high $H_C$ of 895 Oe in the as-cast condition, and increases to 1,078 Oe after annealing at temperatures of 650-700° C. The 650° C. annealed alloy D was observed to be an isotropic polycrystal, with an average grain size of 73 μm and a standard deviation of +35 μm (see FIGS. 3B-3E). While Cu segregation was not detected in the as-cast XRD pattern for Alloy D, it was observed in the 650° C. annealed sample using EBSD scans. The copper precipitates were observed at grain boundaries and inside grains, with an area fraction of only ~0.7% and an average diameter of 0.82 μm. Therefore, the increase in coercivity is here associated with copper precipitation, which may act as pinning sites for domain wall motion, thus increasing the coercivity. After the 650° C. anneal, alloy D also seems less sensitive to thermal cycling, retaining the same RT coercivity, after a subsequent anneal at 700° C. At the optimal annealing condition, alloy D has a $(BH)_{max}$ of 2.06 MGOe, which is slightly higher than the energy product measured in isotropic cast Alnico 2 magnets which have a $(BH)_{max}$ of 1.7 MGOe, an $H_C$ of 580 Oe and a residual induction ($B_r$) of 7.5 kG (MMPA Standard No. 0100-00, "Standard Specification for Permanent Magnet Materials", Magnetic Materials Producers Association, Chicago, IL). The maximum energy product, $(BH)_{max}$, was calculated as the area of the largest rectangle fit inside the demagnetization curve, found in the second quadrant of the hysteresis loop. In comparison with the isotropic cast Alnico PMs, the hard magnetic properties are notable in Alloy D, even though the $B_r$ of 4.9 kG is lower.

Figure 4A:
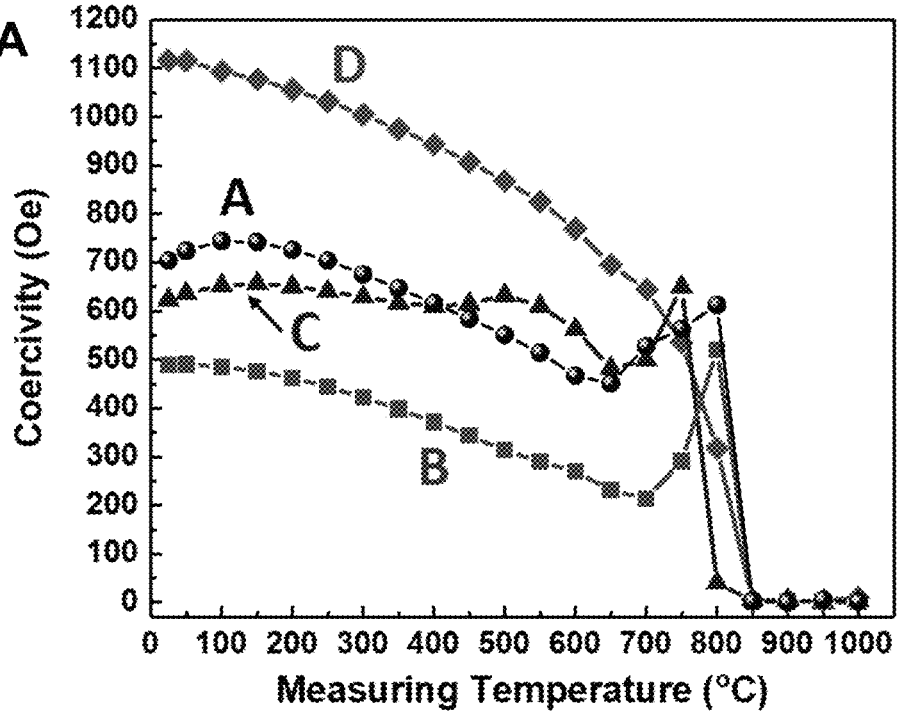
FIG. 4A depicts the temperature dependence of coercivity.
Figure 4B:
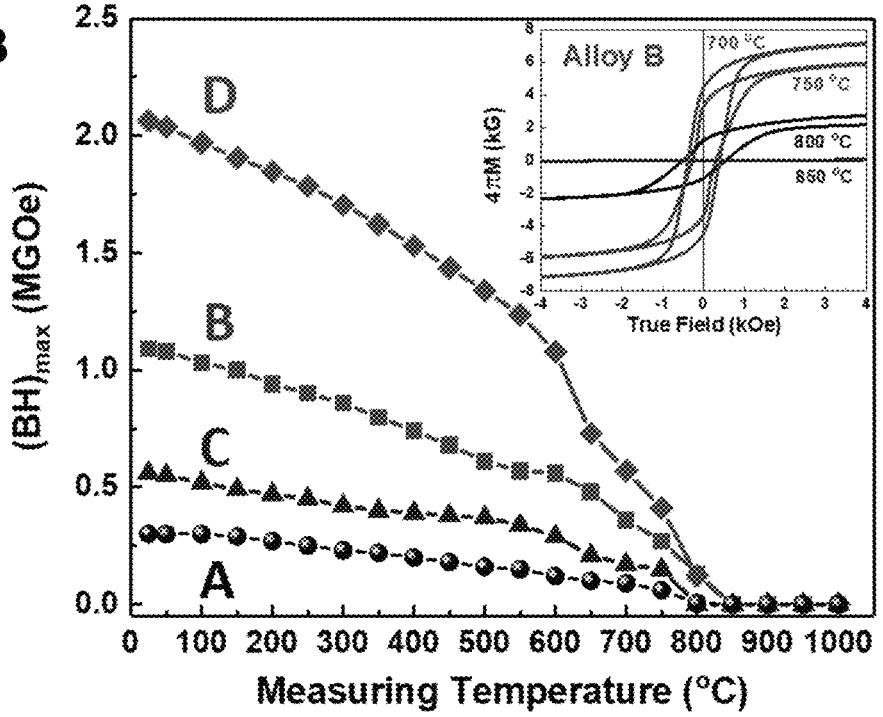
FIG. 4B depicts the $(BH)_{max}$ for 650° C.-annealed HEAs with $Cu_{0.4}$ $Ti_{0.4}$ additions: A—$FeCoNiAlCu_{0.4}Ti_{0.4}$, B—$Fe_2Co_2NiAlCu_{0.4}Ti_{0.4}$, C—$FeCo_2NiAlCu_{0.4}Ti_{0.4}$, and D—$Fe_2CoNiAlCu_{0.4}Ti_{0.4}$.

The service temperature of PMs is a crucial factor for use in motors and generators, with required operating temperatures above 180 °C. The temperature dependence of magnetic properties was characterized to evaluate the stability of the HEA samples optimized at the annealing temperature of 650° C. (shown in FIGS. 4A-4B). The $H_C$ in Alloy D gradually decreases to 0.5 Oe at 850° C., due to the ferromagnetic to paramagnetic phase transition, with a 5.5% reduction in $H_C$ from 25° C. to 200° C. At 450° C. (the maximum service point in Alnico 2 magnets), both $H_C$ and $(BH)_{max}$ in Alloy D retain high values of 907 Oe and 1.44 MGOe, respectively. $H_C$ in Alloy C is fairly flat until 550° C., with an average of 631 Oe. Interestingly, alloys A, B and C have a sharp peak just before the magnetic transition temperatures of 800-850° C. (Curie temperature, $T_C$, wasn't measured as part of this study). The insert in FIG. 4B shows magnetic hysteresis loops at the given temperatures, clearly showing the increase in hysteresis, and the transition to paramagnetism by 850° C. Considering those samples were annealed at 650° C., the peaks occurred above the optimal annealing temperature at which the initial BCC structure underwent spinodal decomposition, originally separating into two BCC phases. The initial decomposed microstructure might be comprised of an $\alpha_1$ phase enriched in Fe and Co and an $\alpha_2$ phase enriched in Ni, Al and Ti, corresponding to a strong ferromagnetic phase and weakly ferromagnetic/non-magnetic matrix, respectively, as is often observed in Alnico magnets (L. Zhou, et al., *Acta Mater.* 74, 224 (2014); Y. Iwama and M. Takeuchi, *Trans. JIM* 15, 371 (1974); L. Zhou, et al., *J. Magn. Magn. Mater.* 471, 142 (2019)). Considering an initial magnetic transition is just above 700° C. and a second magnetic transition is at ~800-850° C. (FIG. 4A), it is assumed that the initial 650° C. phase separation has an Fe-rich phase, with further phase separation forming a Co-rich phase with a higher Curie temperature. Further study will be necessary to understand the structural and compositional changes allowing for a high temperature peak in the $H_C$ of this HEA system.

This work investigated hard magnetic properties in FeCoNiAl based high entropy alloys (HEAs) with additions of Cu and equiatomic Cu/Ti. Additions of Cu and Ti together were more effective at enhancing coercivity than additions with Cu alone. While coercivity may increase, the saturation magnetization and remanence correspondingly decrease. Even so, the Fe-enriched HEA variant with additions of $Cu_{0.4}$ $Ti_{0.4}$ ($Fe_2CoNiAlCu_{0.4}$ $Ti_{0.4}$, denoted as Alloy D) showed promising hard magnetic properties as an isotropic cast magnet, with an $H_C$ of 1,078 Oe and $(BH)_{max}$ of 2.06 MGOe, which are slightly better than those of Alnico 2 magnets. The thermal stability is also sufficient for use at elevated temperatures, retaining ~90% of the RT performance in $H_C$ and $(BH)_{max}$ at 200° C. All samples showed a drastic increase in $H_C$ after an anneal around 650-700° C., which may be strongly related to spinodal decomposition at this annealing temperature.

A significant increase in the high temperature $H_C$ between 650-800° C. was observed in alloys with additions of $Cu_{0.4}$ $Ti_{0.4}$, yielding values higher than at RT in some HEAs. Further study is needed to investigate the potential reasons for the increase in coercivity at these elevated temperatures.

It will, of course, be appreciated that the above description has been given by way of example only and that modifications in detail may be made within the scope of the present invention.

Throughout this application, various patents and publications have been cited. The disclosures of these patents and publications in their entireties are hereby incorporated by reference into this application, in order to more fully describe the state of the art to which this invention pertains.

The invention is capable of modification, alteration, and equivalents in form and function, as will occur to those ordinarily skilled in the pertinent arts having the benefit of this disclosure. While the present invention has been described with respect to what are presently considered the preferred embodiments, the invention is not so limited. To the contrary, the invention is intended to cover various modifications and equivalent arrangements included within the spirit and scope of the description provided above.

What is claimed:

1. A high entropy alloy, comprising:

six non-rare-earth elements consisting of iron (Fe), cobalt (Co), nickel (Ni), aluminum (Al), copper (Cu), and titanium (Ti), said six non-rare-earth elements having the formula $Fe_yCo_zNiAlCu_xTi_x$, wherein each x is independently selected and is from about 0.2 to about 0.4, wherein y is 1 or 2, wherein z is 1 or 2, wherein each of said six non-rare-earth elements is provided in the high entropy alloy at a concentration of about 8.33 to about 25 at %, wherein a said non-rare-earth element is an element that is not a rare earth element, and wherein the high entropy alloy does not include any non-rare-earth element other than said six non-rare-earth elements;

at least one said rare earth element selected from the group consisting of dysprosium (Dy), holmium (Ho), lutetium (Lu), promethium (Pm), thulium (Tm), and ytterbium (Yb), wherein said at least one rare earth element is provided in the high entropy alloy at a concentration of less than 1 at %.

2. The high entropy alloy of claim 1, wherein said iron (Fe), cobalt (Co), nickel (Ni), and aluminum (al) constitute a base alloy Fe:Co:Ni:Al and are provided in said base alloy Fe:Co:Ni:Al in a 1:1:1:1 ratio.

3. The high entropy alloy of claim 1, wherein the high entropy alloy is capable of being used in at least one application selected from the group consisting of motors, generators, exhaust systems, and petroleum-extraction equipment.

4. The high entropy alloy of claim 1, wherein the high entropy alloy is capable of being used in at least one application that is subject to shock and impact forces.

5. The high entropy alloy of claim 1, wherein the high entropy alloy is capable of being used in at least one environment that is subject to high temperature, radiation, and corrosion.

6. A high entropy alloy consisting of six elements and at least one rare earth element, said six elements consisting of iron (Fe), cobalt (Co), nickel (Ni), aluminum (Al), copper (Cu), and titanium (Ti), said at least one rare earth element selected from the group consisting of dysprosium (Dy), holmium (Ho), lutetium (Lu), promethium (Pm), thulium (Tm), and ytterbium (Yb), wherein:

said six elements have the formula $Fe_yCo_zNiAlCu_xTi_x$;

each x is independently selected and is from about 0.2 to about 0.4;

y is 1 or 2;

z is 1 or 2;

each of said six elements is provided in the high entropy alloy at a concentration of about 8.33 to about 25 at %;

said at least one rare earth element is provided in the high entropy alloy at a concentration of less than 1 at %.

7. The high entropy alloy of claim 1, wherein said at least one rare earth element includes dysprosium (Dy).

8. The high entropy alloy of claim 1, wherein said at least one rare earth element includes holmium (Ho).

9. The high entropy alloy of claim 1, wherein said at least one rare earth element includes lutetium (Lu).

10. The high entropy alloy of claim 1, wherein said at least one rare earth element includes promethium (Pm).

11. The high entropy alloy of claim 1, wherein said at least one rare earth element includes thulium (Tm).

12. The high entropy alloy of claim 1, wherein said at least one rare earth element includes ytterbium (Yb).

13. The high entropy alloy of claim 6, wherein said at least one rare earth element includes dysprosium (Dy).

14. The high entropy alloy of claim 6, wherein said at least one rare earth element includes holmium (Ho).

15. The high entropy alloy of claim 6, wherein said at least one rare earth element includes lutetium (Lu).

16. The high entropy alloy of claim 6, wherein said at least one rare earth element includes promethium (Pm).

17. The high entropy alloy of claim 6, wherein said at least one rare earth element includes thulium (Tm).

18. The high entropy alloy of claim 6, wherein said at least one rare earth element includes ytterbium (Yb).

* * * * *